US010077684B2

(12) United States Patent
Kosuda et al.

(10) Patent No.: US 10,077,684 B2
(45) Date of Patent: Sep. 18, 2018

(54) EVAPORATOR AND RANKINE CYCLE SYSTEM

(71) Applicant: Panasonic Corporation, Osaka (JP)

(72) Inventors: Osamu Kosuda, Osaka (JP); Takumi Hikichi, Osaka (JP); Osao Kido, Kyoto (JP)

(73) Assignee: PANASONIC CORPORATION, Osaka (JP)

( * ) Notice: Subject to any disclaimer, the term of this patent is extended or adjusted under 35 U.S.C. 154(b) by 96 days.

(21) Appl. No.: 15/203,603

(22) Filed: Jul. 6, 2016

(65) Prior Publication Data

US 2017/0037743 A1 Feb. 9, 2017

(30) Foreign Application Priority Data

Aug. 4, 2015 (JP) ..... 2015-154023

(51) Int. Cl.

| | |
|---|---|
| ***F01K 25/08*** | (2006.01) |
| ***F22B 29/06*** | (2006.01) |
| ***F22G 1/02*** | (2006.01) |
| ***F22B 37/40*** | (2006.01) |

(52) U.S. Cl.

CPC ..... *F01K 25/08* (2013.01); *F22B 29/067* (2013.01); *F22B 37/40* (2013.01); *F22G 1/02* (2013.01)

(58) Field of Classification Search

CPC ..... F01K 25/08; F22B 29/067; F22B 37/40; F22G 1/02

USPC ..... 60/670, 671

See application file for complete search history.

(56) References Cited

U.S. PATENT DOCUMENTS 4,455,281 A * 6/1984 Ishida ..... B01D 53/8625 422/171
4,685,426 A * 8/1987 Kidaloski ..... F22B 1/1815 122/214
5,131,459 A * 7/1992 Thompson ..... F22B 37/202 122/510

(Continued)

FOREIGN PATENT DOCUMENTS

| | | |
|---|---|---|
| DE | 19737507 | 3/1999 |
| EP | 2386720 | 11/2011 |
| JP | 2011-064451 | 3/2011 |

OTHER PUBLICATIONS

The Extended European Search Report dated Dec. 20, 2016 for the related European Patent Application No. 16179590.1.

(Continued)

*Primary Examiner* — Hoang Nguyen
(74) *Attorney, Agent, or Firm* — McDermott Will & Emery LLP

(57) ABSTRACT

An evaporator includes an introducing portion that introduces a heat source gas from a heat source gas pipe, a heat source gas passage through which the heat source gas introduced from the introducing portion flows, a heating portion that is disposed in the heat source gas passage and at which a working fluid is heated by the heat source gas, an increasing portion at which a cross-sectional area of the heat source gas passage gradually increases from an upstream side towards a downstream side in the heat source gas passage, and a flow regulating plate that is disposed on an upstream side from the heating portion in the heat source gas passage and that has a plurality of holes which allow the heat source gas to pass through the plurality of holes.

6 Claims, 5 Drawing Sheets

(56) References Cited

U.S. PATENT DOCUMENTS

| | | | | |
|---|---|---|---|---|
| 6,050,226 | A * | 4/2000 | Shimada | F22B 1/1815 122/4 D |
| 6,340,002 | B1 * | 1/2002 | Liebig | B01D 53/8631 122/4 D |
| 8,534,039 | B1 | 9/2013 | Pierson et al. | |
| 2011/0061388 | A1 | 3/2011 | Lehar et al. | |
| 2011/0139426 | A1 | 6/2011 | Kagawa et al. | |

OTHER PUBLICATIONS

Communication pursuant to Article 94(3) EPC dated Jun. 19, 2018 for the related European Patent Application No. 16179590.1.

* cited by examiner

EVAPORATOR AND RANKINE CYCLE SYSTEM

BACKGROUND

1. Technical Field

The present disclosure relates to an evaporator and a Rankine cycle system.

2. Description of the Related Art

It has been disclosed that an evaporator of a Rankine cycle system includes a working fluid passage having three zones of a superheater zone, an evaporator zone, and a preheater zone for keeping a working fluid from being excessively heated and degraded. FIG. 5 is a schematic diagram of an evaporator disclosed in Japanese Unexamined Patent Application Publication No. 2011-64451.

As illustrated in FIG. 5, a direct evaporator apparatus 260 includes a housing 244 having a heat source gas inlet 236 and a heat source gas outlet 238. A heat exchange tube 252 is disposed entirely within a heat source gas passage 246. The heat source gas passage 246 is space within the interior of the direct evaporator apparatus 260 that is not occupied by the heat exchange tube 252. The heat exchange tube 252 is configured to accommodate an organic Rankine cycle working fluid 212 such that, during operation, the working fluid enters and exits the housing 244 only twice: once as the working fluid enters the direct evaporator apparatus 260 via a working fluid inlet 240 and once as the working fluid exits the direct evaporator apparatus 260 via a working fluid outlet 242.

The working fluid travels along a working fluid passage defined by the heat exchange tube 252. With the exception of portions 250 of the heat exchange tube 252, the heat exchange tube 252 lies within the heat source gas passage 246. The heat exchange tube 252 defines three zones: a first zone 220 (preheater zone) adjacent to the heat source gas outlet 238, a second zone 222 (evaporator zone) adjacent to the heat source gas inlet 236, and a third zone 224 (superheater zone) disposed between the first zone 220 and the second zone 222. The first zone 220 is not in direct fluid communication with the third zone 224. The working fluid inlet 240 is in direct fluid communication with the first zone 220. The working fluid outlet 242 is in direct fluid communication with the third zone 224. The heat exchange tube 252 includes a plurality of bends in each of the first zone 220, the second zone 222 and the third zone 224. The heat exchange tube 252 is configured in parallel rows in each of the first zone 220, the second zone 222, and the third zone 224. Each of the first zone 220, second zone 222, and third zone 224 of the heat exchange tube 252 is configured in at least one row.

During operation of the direct evaporator apparatus 260 illustrated in FIG. 5, a heat source gas 216 entering at the heat source gas inlet 236 first encounters the second zone 222. Heat from the heat source gas 216 is transferred to the working fluid 212 present in the second zone 222. A heat source gas having a relatively lower temperature and heat content than the heat source gas 216 entering the direct evaporator apparatus 260 at the heat source gas inlet 236 next encounters the third zone 224 in which the working fluid is superheated and a superheated working fluid 228 exits the direct evaporator apparatus 260 via the working fluid outlet 242. A heat source gas having a relatively lower temperature and heat content than the heat source gas first encountering the heat exchange tube 252 in the third zone 224 next encounters the first zone 220 in which the working fluid 212 in a liquid state enters at the working fluid inlet 240 and is preheated while still in a liquid state. The working fluid in the first zone 220 is conducted along the heat exchange tube 252 to the second zone 222 in which the working fluid is evaporated and supplied to the third zone 224.

SUMMARY

In one general aspect, the techniques disclosed here feature an evaporator including an introducing portion that introduces a heat source gas from a heat source gas pipe, a heat source gas passage through which the heat source gas introduced from the introducing portion flows, a heating portion that is disposed in the heat source gas passage and at which a working fluid is heated by the heat source gas, an increasing portion that is located between the introducing portion and the heating portion, that constitutes the heat source gas passage, and at which a cross-sectional area of the heat source gas passage gradually increases from an upstream side towards a downstream side in the heat source gas passage, and a flow regulating plate that is disposed on an upstream side from the heating portion in the heat source gas passage and that has a plurality of holes which allow the heat source gas to pass through the plurality of holes.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Existing Rankine cycle systems carry the risk of having a region in which the flow rate of a heat source gas is locally increased and excessively heating a working fluid in the region, resulting in degradation of the working fluid.

The present disclosure provides a new technique for heating the working fluid to a higher temperature in an evaporator while preventing the working fluid from being excessively heated.

Figure 5:
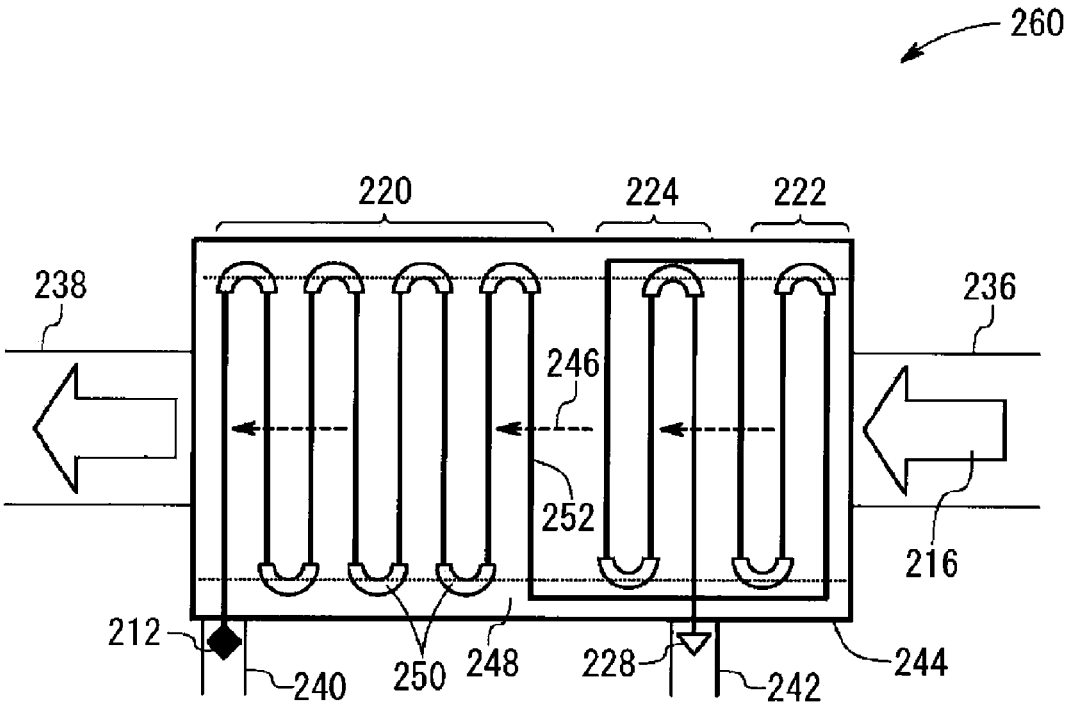
FIG. 5 is a configuration diagram of an evaporator of an existing Rankine cycle system.

In the existing direct evaporator apparatus 260 illustrated in FIG. 5, the cross-sectional area of the heat source gas passage 246 increases discontinuously and immediately at a portion at which the heat source gas inlet 236 is connected to the housing 244. The flow rate of a heat source gas depends on the cross-sectional area of the heat source gas inlet 236. Accordingly, the flow rate of the heat source gas flowing through the heat source gas passage 246 is very high at a position near the center of the housing 244. When the flow rate of the heat source gas is locally increased in a region, the working fluid may be excessively heated and degraded in the region. It is accordingly necessary for a target temperature that the temperature of the working fluid finally reaches to be decreased to prevent degradation of the working fluid. This makes it difficult to improve the performance of Rankine cycle systems.

An evaporator according to a first aspect of the present disclosure includes an introducing portion that introduces a heat source gas from a heat source gas pipe, a heat source gas passage through which the heat source gas introduced from the introducing portion flows, a heating portion that is disposed in the heat source gas passage and at which a working fluid is heated by the heat source gas, an increasing portion that is located between the introducing portion and the heating portion, that constitutes the heat source gas passage, and at which a cross-sectional area of the heat source gas passage gradually increases from an upstream side towards a downstream side in the heat source gas passage, and a flow regulating plate that is disposed on an upstream side from the heating portion in the heat source gas passage and that has a plurality of holes which allow the heat source gas to pass through the plurality of holes.

According to the first aspect, the increasing portion enables the cross-sectional area of the heat source gas passage to be increased and the flow regulating plate regulates the flow of the heat source gas so that the flow rate of the heat source gas can be prevented from being locally increased. The working fluid can thereby be heated to a higher temperature while being prevented from being excessively heated. The use of the evaporator according to the first aspect enables the working fluid at a higher temperature to be supplied to the outside (for example, an expander), thereby enabling a high-performance Rankine cycle system to be provided.

In a second aspect of the present disclosure, for example, an open area ratio of the flow regulating plate may be greater than or equal to 15% and less than or equal to 35%. The open area ratio in this range enables pressure loss to be sufficiently suppressed while preventing pyrolysis of the working fluid.

In a third aspect of the present disclosure, for example, the heating portion of the evaporator according to the first aspect or the second aspect may include a heat transfer pipe constituting a working fluid passage. The diameter of each of the plurality of holes may be smaller than the outer diameter of the heat transfer pipe. When the diameter of each of the plurality of holes is appropriately small, the distance between the adjacent holes is sufficiently small and a strong effect of regulating the flow is thereby achieved.

In a fourth aspect of the present disclosure, for example, the flow regulating plate of the evaporator according to any one of the first to third aspects may be disposed between the increasing portion and the heating portion in a direction in which the heat source gas flows. The flow regulating plate disposed at such a position achieves a stronger effect of regulating the flow.

In a fifth aspect of the present disclosure, for example, the heating portion of the evaporator according to any one of the first to fourth aspects may include a working fluid passage through which the working fluid flows. The working fluid passage may include a plurality of tiers including a first tier, a second tier, and a third tier that are arranged in the direction in which the heat source gas flows. The working fluid passage may have a meandering shape at each of the plurality of tiers. The first tier may be a tier located on the most upstream side in the direction in which the heat source gas flows. The second tier may be a tier including a working fluid outlet through which the working fluid is discharged from the heating portion to the outside. The third tier may be a tier that is located on the most downstream side in the direction in which the heat source gas flows and that includes a working fluid inlet through which the working fluid is introduced from the outside into the heating portion. Such a structure is advantageous for preventing the working fluid from being excessively heated.

In a sixth aspect of the present disclosure, for example, the working fluid passage of the evaporator according to the fifth aspect may include a superheat zone including the first tier and the second tier and an evaporation zone including the third tier. The second tier may be disposed on the most downstream side in the superheat zone in the direction in which the heat source gas flows, and a plurality of tiers including the first tier and the second tier may define the superheat zone such that heat is exchanged between the heat source gas and the working fluid in a parallel-flow manner. The third tier may be disposed on the most downstream side in the evaporation zone in the direction in which the heat source gas flows, and a plurality of tiers including the third tier may define the evaporation zone such that heat is exchanged between the heat source gas and the working fluid in a counter-flow manner. The working fluid flowing through a tier on the most upstream side in the evaporation zone in the direction in which the heat source gas flows may be supplied to the first tier. Such a structure enables the working fluid to be prevented from being excessively heated while enabling heat to be efficiently exchanged between the heat source gas and the working fluid.

In a seventh aspect of the present disclosure, for example, the working fluid for the evaporator according to any one of the first to sixth aspects may be an organic working fluid.

A Rankine cycle system according to an eighth aspect of the present disclosure includes the evaporator according to any one of the first to seventh aspects.

A Rankine cycle system according to a ninth aspect of the present disclosure includes a passage that forms a loop through which an organic working fluid flows, an expander disposed in the passage, a condenser disposed in the passage, a generator driven by the expander, and the evaporator according to any one of the first to seventh aspects, the evaporator being disposed in the passage. The heat transfer pipe constitutes part of the passage.

An evaporator according to another first aspect of the present disclosure includes a casing that has an inlet and an outlet, and a heat transfer pipe at least a part of which is disposed in the casing. The casing includes a first portion, a cross-sectional area of the first portion gradually increasing with increasing distance from the inlet of the casing. The casing includes a flow regulating plate that is located between the first portion and the heat transfer pipe in the casing and that has a plurality of holes.

In another second aspect of the present disclosure, for example, an open area ratio of the flow regulating plate of the evaporator according to the other first aspect may be greater than or equal to 15% and less than or equal to 35%.

In another third aspect of the present disclosure, for example, the diameter of each of the plurality of holes in the evaporator according to the other first aspect or the other second aspect may be smaller than the outer diameter of the heat transfer pipe.

In another fourth aspect of the present disclosure, for example, a heat source gas may flow from the inlet to the outlet of the casing of the evaporator according to any one of the other first aspect to the other third aspect. A working fluid may flow through the heat transfer pipe. The heat transfer pipe may include a plurality of tiers including a first tier, a second tier, and a third tier that are arranged in the direction in which the heat source gas flows. The heat transfer pipe may have a meandering shape at each of the plurality of tiers. The first tier may be a tier located on the most upstream side in the direction in which the heat source gas flows. The second tier may be a tier including a working fluid outlet through which the working fluid is discharged from the casing to the outside. The third tier may be a tier that is located on the most downstream side in the direction in which the heat source gas flows and that includes a working fluid inlet through which the working fluid is introduced from the outside into the casing.

In another fifth aspect of the present disclosure, for example, the heat transfer pipe of the evaporator according to the other fourth aspect may include a superheat zone including the first tier and the second tier and an evaporation zone including the third tier. The second tier may be disposed on the most downstream side in the superheat zone in the direction in which the heat source gas flows, and a plurality of tiers including the first tier and the second tier may define the superheat zone such that heat is exchanged between the heat source gas and the working fluid in a parallel-flow manner. The third tier may be disposed on the most downstream side in the evaporation zone in the direction in which the heat source gas flows, and a plurality of tiers including the third tier may define the evaporation zone such that heat is exchanged between the heat source gas and the working fluid in a counter-flow manner. The working fluid flowing through a tier on the most upstream side in the evaporation zone in the direction in which the heat source gas flows may be supplied to the first tier.

In another sixth aspect of the present disclosure, for example, the working fluid for the evaporator according to any one of the other first aspect to the other fifth aspect may be an organic working fluid.

A Rankine cycle system according to another seventh aspect of the present disclosure includes the evaporator according to any one of the other first aspect to the other sixth aspect.

A Rankine cycle system according to another eighth aspect of the present disclosure includes a passage that forms a loop through which an organic working fluid flows, an expander disposed in the passage, a condenser disposed in the passage, a generator driven by the expander, and the evaporator according to any one of the other first aspect to the other sixth aspect, the evaporator being disposed in the passage. The heat transfer pipe constitutes part of the passage.

Embodiments of the present disclosure will hereinafter be described with reference to the drawings. The present disclosure is not limited to the following embodiments.

Figure 1:
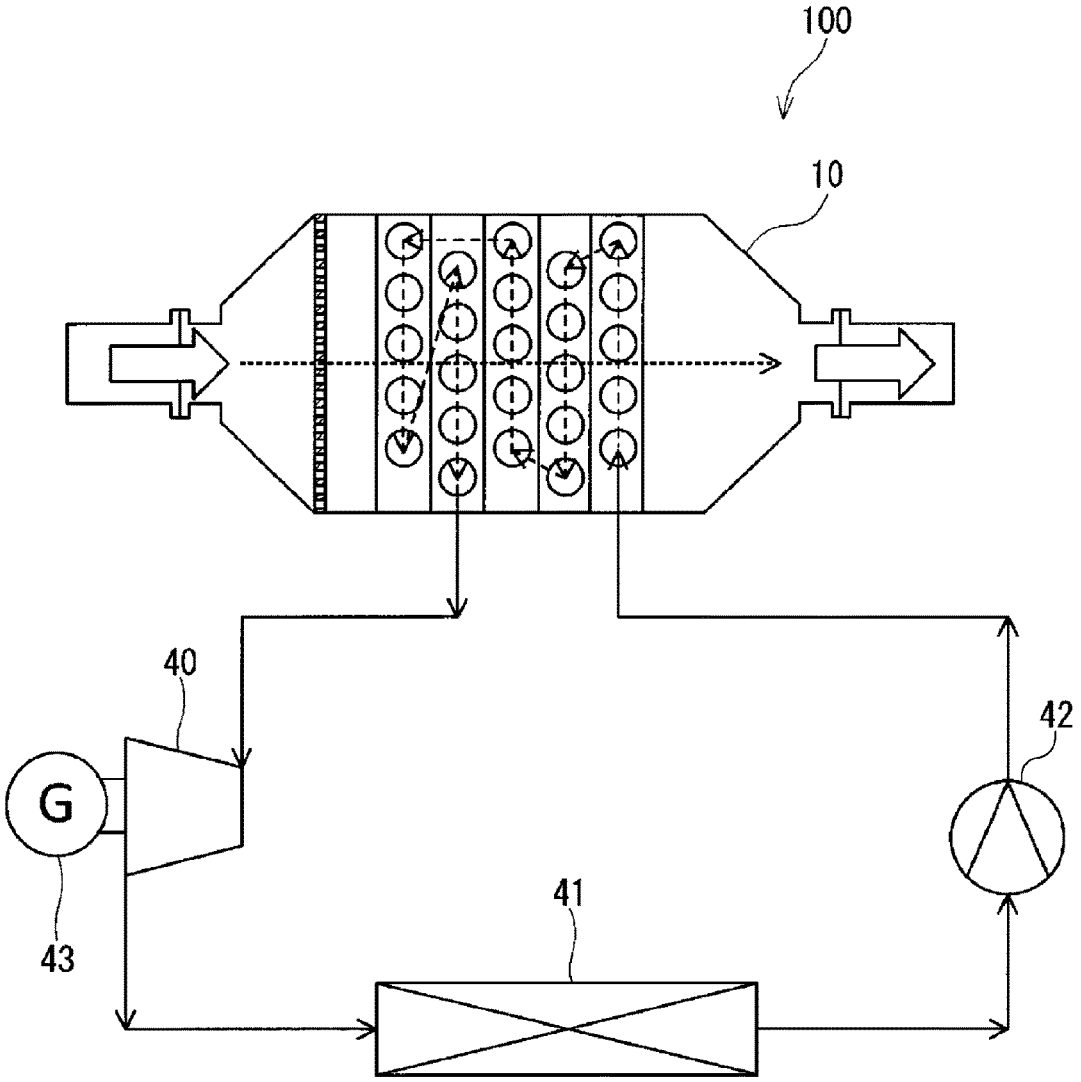
FIG. 1 is a configuration diagram of a Rankine cycle system according to an embodiment of the present disclosure.

FIG. 1 is a configuration diagram of a Rankine cycle system according to an embodiment of the present disclosure. A Rankine cycle system 100 includes an evaporator 10, an expander 40, a condenser 41, and a pump 42. These components are connected through pipes in this order and form a loop so that a closed circuit is formed. The Rankine cycle system 100 may include another component such as a regenerator.

The expander 40 expands a working fluid to convert expansion energy of the working fluid into rotational power. The rotation shaft of the expander 40 is connected to a generator 43. The generator 43 is driven by the expander 40. An example of the expander 40 is a displacement expander or a turbo expander. Examples of the displacement expander include a scroll expander, a rotary expander, a screw expander, and a reciprocating expander. A turbo expander is an expansion turbine.

A displacement expander is recommended as the expander 40. In general, a displacement expander has a wider range of rotational speed than the rotational speed of a turbo expander and achieves a high expander efficiency. A displacement expander, for example, can be operated at a rotational speed less than or equal to half of a rated rotational speed while maintaining a high efficiency. In other words, a displacement expander can reduce the amount of power generation to half of a rated power generation amount or less while maintaining a high efficiency. The use of a displacement expander, which has such characteristics, enables flexible response to changes in the power generation due to changes in the state of a heat source gas supplied to the evaporator 10.

The condenser 41 allows heat to be exchanged between a high-temperature working fluid discharged from the expander 40 and another medium such as air or water to cool the working fluid. A heat exchanger such as a plate heat exchanger or a double pipe heat exchanger can be used as the condenser 41. The type of the condenser 41 is determined appropriately depending on the type of the other medium. In the case where a liquid such as water is used as the other medium, a plate heat exchanger or a double pipe heat exchanger can be preferably used as the condenser 41. In the case where a gas such as air is used as the other medium, a fin-tube heat exchanger can be preferably used as the condenser 41.

The pump 42 sucks in and pressurizes the working fluid that exits the condenser 41 and supplies the pressurized working fluid to the evaporator 10. A typical displacement pump or turbo pump can be used as the pump 42. Examples of the displacement pump include a piston pump, a gear pump, a vane pump, and a rotary pump. Examples of the turbo pump include a centrifugal pump, a mixed-flow pump, and an axial-flow pump.

The evaporator 10 is a heat exchanger that absorbs the thermal energy of the heat source gas. Heat is exchanged between the heat source gas and the working fluid for the Rankine cycle system 100 through the evaporator 10. The working fluid is thereby heated and evaporated.

An organic working fluid can be preferably used as the working fluid for the Rankine cycle system 100. Examples of the organic working fluid include halogenated hydrocarbon, hydrocarbon, and alcohol. Examples of the halogenated hydrocarbon include R-123, R-245fa, R-1233zd, and R-365mfc. Examples of the hydrocarbon include alkanes such as propane, butane, pentane, and isopentane. An example of the alcohol is ethanol. Such an organic working fluid may be used alone; any mixture of two or more of the organic working fluids may be used.

The structure of the evaporator 10 will now be described in detail.

Figure 2:
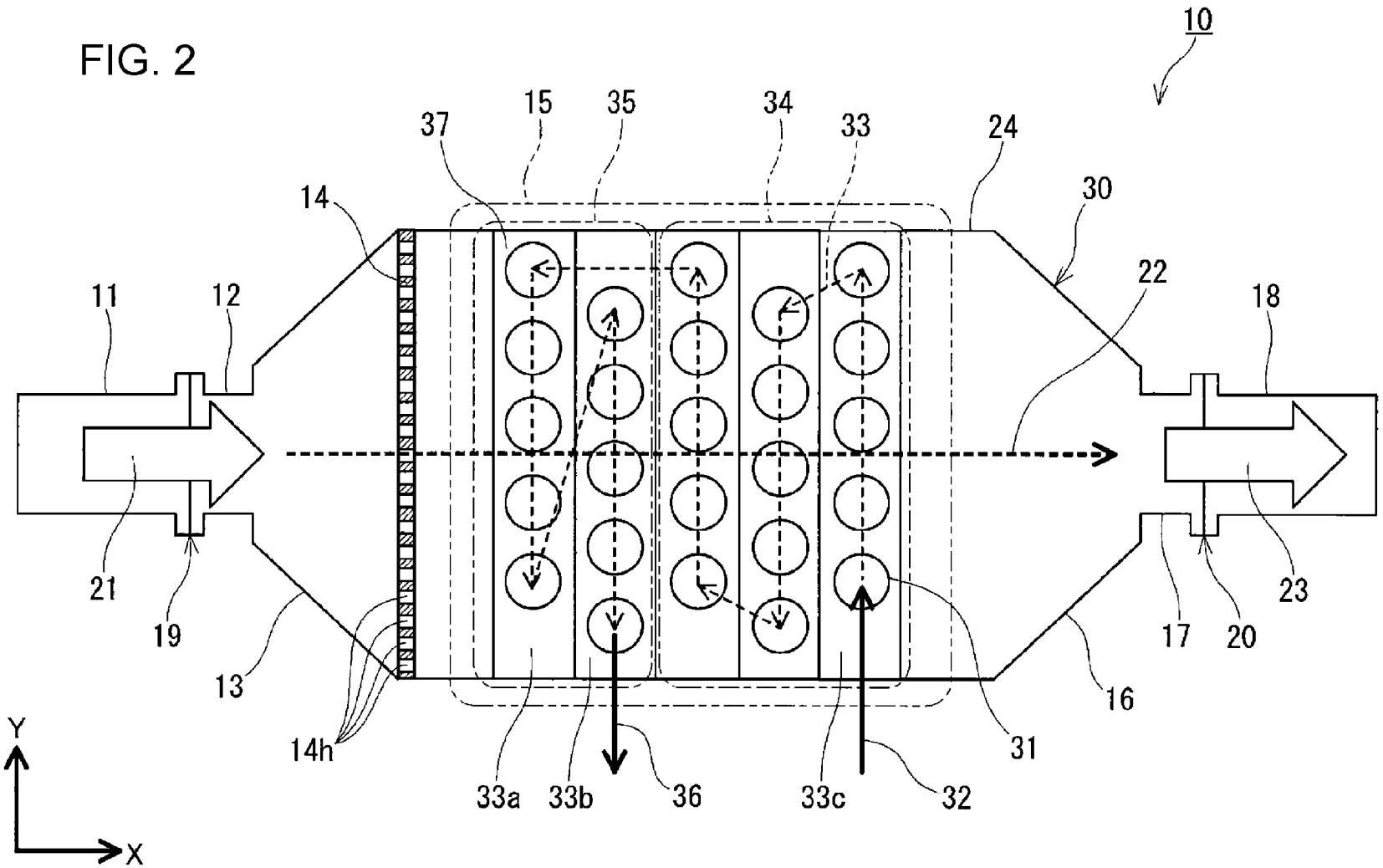
FIG. 2 is a configuration diagram of an evaporator of the Rankine cycle system illustrated in FIG. 1.

As illustrated in FIG. 2, the evaporator 10 includes a tube 30 (casing 30), a flow regulating plate 14, and a heating portion 15. The tube 30 is a portion constituting a heat source gas passage 22 through which the heat source gas flows. The flow regulating plate 14 and the heating portion 15 are disposed in the tube 30. The heating portion 15 is a portion constituting a working fluid passage of the Rankine cycle system.

The tube 30 includes an introducing portion 12, an increasing portion 13 (first portion 13), an intermediate portion 24, a decreasing portion 16, and a heat source gas discharging portion 17. The heat source gas is introduced into the inside of the evaporator 10 from the introducing portion 12, passes through the increasing portion 13, the flow regulating plate 14, the heating portion 15, and the decreasing portion 16 in this order and is discharged from the evaporator 10 to the outside through the heat source gas discharging portion 17. In the present disclosure, the term "cross section" means a cross section perpendicular to the direction in which the heat source gas flows.

The introducing portion 12 is connected at a heat source gas inlet pipe joint 19 to a heat source gas inlet pipe 11. The cross-sectional shape of the heat source gas inlet pipe 11 is, for example, circular. Accordingly, the cross-sectional shape of the introducing portion 12 may also be circular. The introducing portion 12 defines a heat source gas inlet 21. The heat source gas is introduced into the inside of the evaporator 10 through the heat source gas inlet 21, and the heat source gas at a high temperature does not leak from the joint 19. The method of connecting the introducing portion 12 and the heat source gas inlet pipe 11 is not particularly limited. In the case where the introducing portion 12 and the heat source gas inlet pipe 11 each have a flange structure at an end thereof, the introducing portion 12 and the heat source gas inlet pipe 11 can be connected to each other by bolting (flange connection). The introducing portion 12 and the heat source gas inlet pipe 11 may be completely joined to each other by another connecting method such as welding.

The heat source gas introduced into the inside of the evaporator 10 from the introducing portion 12 then passes through the increasing portion 13. The increasing portion 13 is located between the introducing portion 12 and the intermediate portion 24. In other words, the increasing portion 13 is located between the introducing portion 12 and the heating portion 15. The increasing portion 13 constitutes the heat source gas passage 22 between the introducing portion 12 and the heating portion 15. At the increasing portion 13, the cross-sectional area of the heat source gas passage 22 gradually increases at a predetermined rate from an upstream side towards a downstream side in the heat source gas passage 22. In the embodiment, the cross-sectional area of the tube 30 continuously increases and the increasing portion 13 is thereby formed into a truncated cone shape. At the increasing portion 13, the cross-sectional area of the heat source gas passage 22 continuously increases.

The heat source gas passes through the flow regulating plate 14 after passing through the increasing portion 13. The flow regulating plate 14 is disposed on the upstream side from the heating portion 15 in the heat source gas passage 22. The flow regulating plate 14 has a plurality of holes **14*h* which allow the heat source gas to pass through the plurality of holes 14*h* and performs a function of regulating the flow of the heat source gas. That is, the flow regulating plate 14 provides fluid resistance in the heat source gas passage 22. The flow rate of the heat source gas is decreased by the flow regulating plate 14. This eliminates deviation of distribution of the flow rate of the heat source gas in the heat source gas passage 22. In the embodiment, the flow regulating plate 14 is disposed at the upstream end of the intermediate portion 24 (at the downstream end of the increasing portion 13). In other words, the flow regulating plate 14 is disposed between the increasing portion 13 and the heating portion 15 in the direction in which the heat source gas flows. The flow regulating plate 14 disposed at such a position enables a stronger effect of regulating the flow. The flow regulating plate 14, however, may be disposed at the increasing portion 13**.

Figure 3:
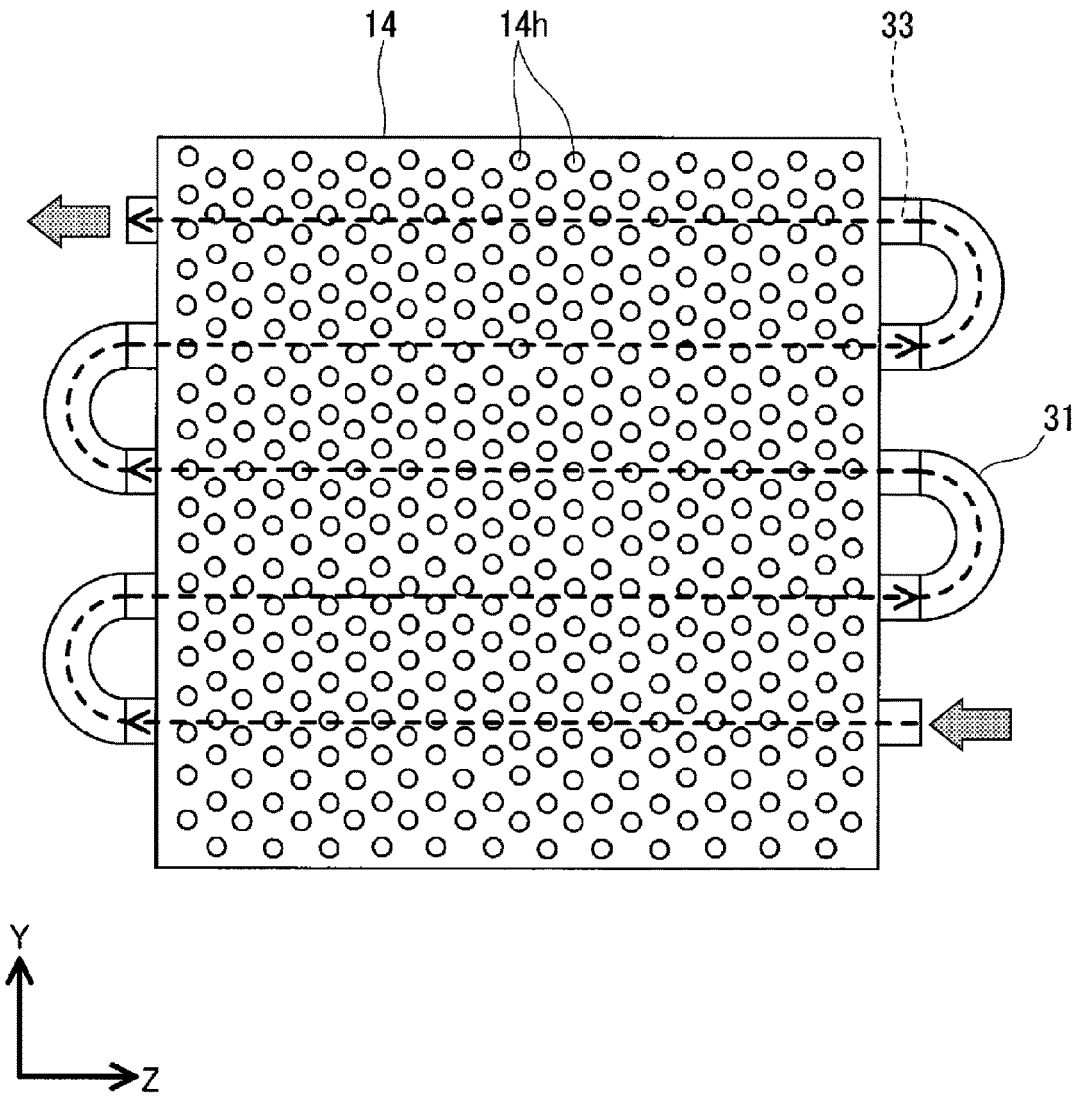
FIG. 3 is a plan view of a flow regulating plate of the evaporator illustrated in FIG. 2.

As illustrated in FIG. 3, for example, the flow regulating plate 14 has, in plan view, the same shape as the cross-sectional shape of the tube 30 at a position at which the flow regulating plate 14 is disposed. The flow regulating plate 14 typically has, in plan view, the same shape as the cross-sectional shape of the intermediate portion 24 (the cross-sectional shape of the heat source gas passage 22 at the intermediate portion 24). There is no space between the flow regulating plate 14 and the tube 30 in the direction parallel to a main surface of the flow regulating plate 14, and the heat source gas can pass through only the holes **14*h* of the flow regulating plate 14. A space, however, may be present between the flow regulating plate 14 and the tube 30. The flow regulating plate 14 may be joined to the tube 30 by a joining method such as welding or may be fastened to the tube 30 with a fastener such as a bolt. In the case where the flow regulating plate 14 has a flange structure at a peripheral portion thereof and the intermediate portion 24 of the tube 30 has a flange structure at an end thereof (and/or the increasing portion 13 has a flange structure at an end thereof), the flow regulating plate 14 can be secured to the intermediate portion 24 of the tube 30** by bolting (flange connection).

As illustrated in FIG. 3, the flow regulating plate 14 has the holes **14*h* that are regularly arranged. In the embodiment, the holes 14*h* are formed in a staggered arrangement. The holes 14*h* may be formed in another regular arrangement such as a lattice arrangement. The shape and size of the holes 14*h* are not particularly limited. The holes 14*h* are typically circular in plan view. The holes 14*h*, however, may have another shape such as a rectangular shape or a triangular shape. The diameter of the holes 14*h* (diameter in plan view) is, for example, smaller than the outer diameter of heat transfer pipes 31 constituting the heating portion 15. When the diameter of the holes 14*h* is appropriately small, the distance between the adjacent holes 14*h* is sufficiently small, thereby a strong effect of regulating the flow is achieved and the heat source gas can uniformly flow up to the end of the heat source gas passage 22. The lower limit of the diameter of the holes 14*h* is, for example, 0.5 mm from the perspective of processing cost. When the holes 14*h* have a shape other than a circular shape, the diameter of the holes 14*h* can be determined by the diameter of a circle having the same area as an opening area of each hole 14*h* (opening area in plan view). It is not essential that all the holes 14*h* have the same size and the same shape. For example, the flow regulating plate 14** may have a first hole and a second hole having a diameter different from the diameter of the first hole.

In the embodiment, the flow regulating plate 14 is disposed in the direction perpendicular to the direction in which the heat source gas flows. In other words, the direction of the normal of the main surface (surface having the maximum area) of the flow regulating plate 14 corresponds to the direction in which the heat source gas flows. A specific example of the flow regulating plate 14 is a perforated metal plate. The perforated metal plate is obtained by performing on a metal plate a perforating process in which holes are formed. Other materials such as a wire net and porous material may be used for the flow regulating plate 14.

The heat source gas passes through the intermediate portion 24 after passing through the flow regulating plate 14. The heating portion 15 is disposed at the intermediate portion 24. That is, the heating portion 15 is disposed in the heat source gas passage 22. In the embodiment, the cross-sectional shape of the intermediate portion 24 is rectangular (more specifically, square). The cross-sectional shape of the intermediate portion 24 is constant in the direction in which the heat source gas flows. That is, the cross-sectional area of the heat source gas passage 22 is constant throughout the intermediate portion 24. The working fluid is heated by the heat source gas at the heating portion 15.

The heating portion 15 includes a working fluid passage 33 through which the working fluid flows. The working fluid passage 33 includes a plurality of tiers including a first tier 33*a*, a second tier 33*b*, and a third tier 33*c* that are arranged in the direction in which the heat source gas flows. The working fluid passage 33 has a meandering shape at each of the plurality of tiers. In the embodiment, the heating portion 15 includes five tiers in the direction in which the heat source gas flows. The first tier 33*a* is a tier located on the most upstream side in the direction in which the heat source gas flows. The second tier 33*b* is a tier including a working fluid outlet 36 through which the working fluid is discharged from the heating portion 15 to the outside (from the evaporator 10 to the outside). The third tier 33*c* is a tier that is located on the most downstream side in the direction in which the heat source gas flows and that includes a working fluid inlet 32 through which the working fluid is introduced from the outside into the heating portion 15. Such a structure is advantageous for preventing the working fluid from being excessively heated. A temperature sensor (not illustrated) is installed in the working fluid passage 33. The temperature of the working fluid in the evaporator 10 can be adjusted on the basis of an output value (detection value) of the temperature sensor.

In the embodiment, the heating portion 15 has a structure of a fin-tube heat exchanger including heat transfer fins 37 and the heat transfer pipes 31. The heat transfer fins 37 are arranged such that the front surface and the back surface thereof are parallel to the direction in which the heat source gas flows. In other words, the heat transfer fins 37 are parallel to the direction of the normal of the flow regulating plate 14. The front surface and the back surface of the heat transfer fins 37 can be parallel also to the vertical direction. A space between the heat transfer fins 37 corresponds to the heat source gas passage 22. The heat transfer pipes 31 are arranged in tiers in the direction of the flow of the heat source gas, which is to exchange heat with the working fluid. In the embodiment, the heat transfer pipes 31 are arranged in five tiers in the direction of the flow.

As illustrated in FIG. 2 and FIG. 3, the heat transfer pipes 31 are arranged also in rows (in five rows in the embodiment) in a direction perpendicular to the direction in which the heat source gas flows (for example, the vertical direction). That is, the heat transfer pipes 31 are arranged in a matrix in both the horizontal direction (x-direction) and the height direction (y-direction). The working fluid passes through the heat transfer pipes 31 located at one tier and is then transferred to one of the heat transfer pipes 31 located at another tier. The heat transfer pipes 31 are disposed in a staggered arrangement when the heating portion 15 is viewed in a direction perpendicular to the front surfaces of the heat transfer fins 37. In the embodiment, the heat transfer pipes 31 are connected to each other such that the working fluid passage 33 is a single passage. It is, however, not essential that the single passage is formed of all of the heat transfer pipes 31. A known component such as a distributor may be used to form two or more passages in parallel.

In the embodiment, the working fluid inlet 32 is located at the tier (third tier 33*c*) located on the most downstream side in the direction in which the heat source gas flows. The working fluid enters the heating portion 15 through the working fluid inlet 32. The working fluid flows to the intermediate portion of the working fluid passage 33 and then enters the tier (first tier 33*a*) located on the most upstream side in the direction in which the heat source gas flows. The working fluid flows through the tier (first tier 33*a*) located on the most upstream side and then enters a tier (second tier 33*b*) other than the tier (first tier 33*a*) on the most upstream side. The working fluid is discharged from the heating portion 15 to the outside through the working fluid outlet 36 formed at the second tier 33*b*.

Specifically, the working fluid passage 33 includes an evaporation zone 34 and a superheat zone 35. The evaporation zone 34 is a zone including the third tier 33*c*. The superheat zone 35 is a zone including the first tier 33*a* and the second tier 33*b*. The second tier 33*b* is disposed on the most downstream side in the superheat zone 35 in the direction in which the heat source gas flows. Tiers including the first tier 33*a* and the second tier 33*b* define the superheat zone 35 such that heat is exchanged between the heat source gas and the working fluid in a parallel-flow manner. The third tier 33*c* is disposed on the most downstream side in the evaporation zone 34 in the direction in which the heat source gas flows. Tiers including the third tier 33*c* define the evaporation zone 34 such that heat is exchanged between the heat source gas and the working fluid in a counter-flow manner. The working fluid flowing through the tier on the most upstream side in the evaporation zone 34 in the direction in which the heat source gas flows is supplied to the first tier 33*a*. Such a structure enables the working fluid to be prevented from being excessively heated while enabling heat to be efficiently exchanged between the heat source gas and the working fluid.

Right after the working fluid discharged from the pump 42 enters the evaporator 10 (heating portion 15), the working fluid is in a liquid state or gas-liquid two-phase state and the temperature of the working fluid is lowest in the evaporator 10. The working fluid flows through the working fluid passage 33, is heated by the heat source gas, and is evaporated. In the embodiment, the working fluid becomes the gas-liquid two-phase state in the evaporation zone 34 that is the first half of the working fluid passage 33. The working fluid changes into a gas state from the gas-liquid two-phase state in the superheat zone 35 that is the second half of the working fluid passage 33. At the outlet of the evaporator 10 (working fluid outlet 36), the working fluid is in the gas state and the temperature of the working fluid is highest in the evaporator 10.

In the evaporation zone 34, since the working fluid is in the liquid state or the gas-liquid two-phase state, heat conducted from the heat source gas to the working fluid is used for phase change. Accordingly, variation in the temperature of the working fluid is suppressed and it is unlikely that pyrolysis of the working fluid will occur. In contrast, in the superheat zone 35, heat conducted from the heat source gas to the working fluid is used for varying the temperature. Accordingly, pyrolysis of the working fluid may occur.

The probability of pyrolysis of the working fluid is reduced by changing the position of the working fluid outlet 36 to a position on the downstream side in the direction in which the heat source gas flows. However, in the case where the position of the working fluid outlet 36 is changed to a position on the downstream side in the direction in which the heat source gas flows, the temperature of the heat source gas at a heat source gas outlet 23 is increased. More specifically, the amount of heat exchanged between the heat source gas and the working fluid is reduced and the heat exchange efficiency of the evaporator 10 is reduced. It is necessary to dispose the working fluid outlet 36 on the upstream side in the direction in which the heat source gas flows in order to achieve a high heat exchange efficiency.

In the embodiment, the first tier 33*a* is adjacent to the second tier 33*b* and the second tier 33*b* includes the working fluid outlet 36. In this case, a high heat exchange efficiency can be achieved. However, the temperature of the heat source gas is high on the upstream side in the direction in which the heat source gas flows and the probability that pyrolysis of the working fluid will occur is accordingly increased.

The higher the temperature of the working fluid, the higher the probability that pyrolysis of the working fluid will occur. Pyrolysis of the working fluid is greatly affected by not only the temperature of the working fluid but also thermal conditions such as the temperature of the heat source gas and the flow rate of the heat source gas. Pyrolysis of the working fluid may occur at a position at which heat conducted from the heat source gas is locally increased.

As described with reference to FIG. 5, in the direct evaporator apparatus 260 disclosed in Japanese Unexamined Patent Application Publication No. 2011-64451, there is no obstacle between the heat source gas inlet 236 and the second zone 222, and the heat source gas 216 can smoothly reach the second zone 222 and the third zone 224 from the heat source gas inlet 236. High-temperature and low-density heat source gas is accordingly supplied to the second zone 222 and the third zone 224 at a high flow rate. In this case, pyrolysis of the working fluid is likely to occur at the second zone 222 and the third zone 224. Although the cross-sectional area of the heat source gas passage 246 is increased at the joint between the heat source gas inlet 236 and the housing 244, it is difficult to decrease the flow rate of the heat source gas by only increasing the cross-sectional area of the heat source gas passage. Accordingly, the flow rate of the heat source gas in the heat source gas passage 246 is very high at a position near the center of the housing 244 but is low at a position near a housing wall 248. In a region in which the flow rate of the heat source gas is locally increased, the working fluid is excessively heated and pyrolysis of the working fluid occurs.

In the embodiment, the increasing portion 13 and the flow regulating plate 14 are disposed upstream of the superheat zone 35. The increasing portion 13 and the flow regulating plate 14 have not only a function of decreasing the flow rate of the heat source gas but also a function of eliminating deviation of distribution of the flow rate of the heat source gas.

The effect of regulating the flow by the flow regulating plate 14 is affected by the open area ratio of the flow regulating plate 14. The "open area ratio" is a ratio of the total opening area of the holes 14*h* to the area of the flow regulating plate 14 (area of a main surface). A simulation was carried out under predetermined conditions (the temperature of the heat source gas was 400° C. and the flow rate of the heat source gas at the heat source gas inlet 21 was 18 m/sec) to investigate the relationship between the open area ratio of the flow regulating plate 14, the maximum temperatures of the inner wall surfaces of the heat transfer pipes 31, and pressure loss. The result is illustrated in FIG. 4.

Figure 4:
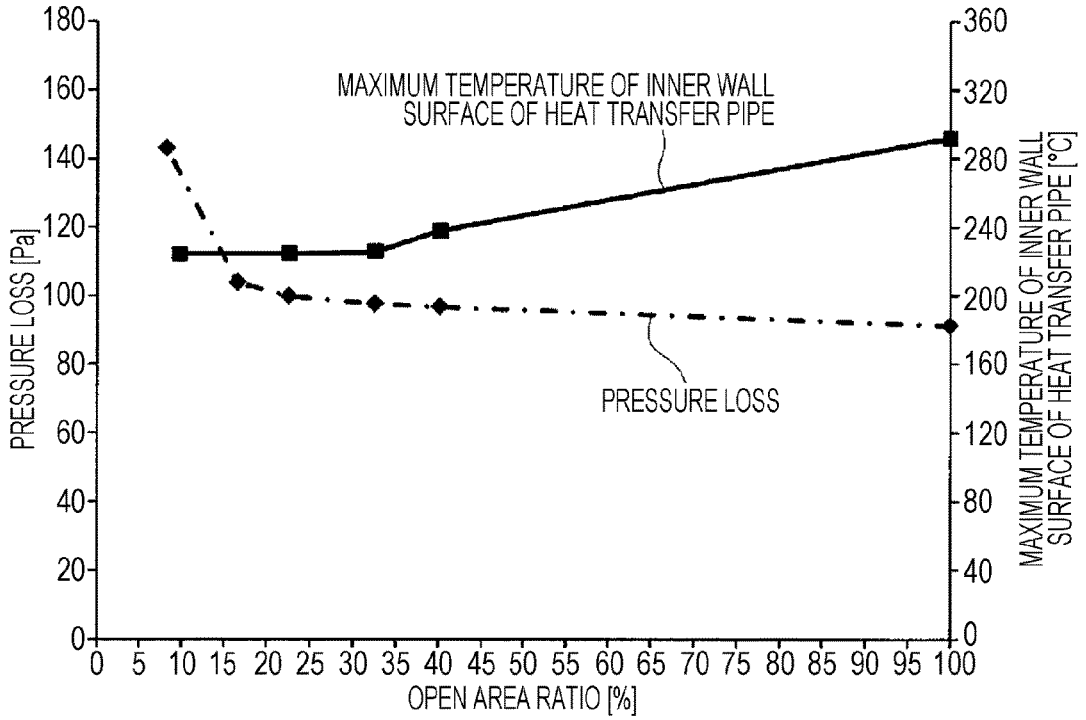
FIG. 4 is a graph representing the relationship between the open area ratio of the flow regulating plate, the maximum temperatures of inner wall surfaces, and pressure loss.

As illustrated in FIG. 4, the maximum temperatures of the inner wall surfaces of the heat transfer pipes 31 are the maximum temperatures of the inner wall surfaces of the heat transfer pipes 31 under respective conditions. When the maximum temperatures of the inner wall surfaces of the heat transfer pipes 31 exceed the pyrolysis temperature of the working fluid, pyrolysis of the working fluid occurs. The pressure loss is pressure loss of the heat source gas that is caused at the increasing portion 13 and the flow regulating plate 14.

As the open area ratio of the flow regulating plate 14 decreases, a stronger effect of regulating the flow can be achieved. In this case, there is a tendency that the region in which the flow rate of the heat source gas is locally increased is eliminated and the maximum temperature of the inner wall surface of each heat transfer pipe 31 is decreased. When the open area ratio is 35% or less, the maximum temperature of the inner wall surface of each heat transfer pipe 31 can be maintained below a predetermined upper limit temperature. The predetermined upper limit temperature is lower than the pyrolysis temperature of the working fluid. The predetermined upper limit temperature is determined to be, for example, 20 to 30° C. lower than the pyrolysis temperature of the working fluid. For example, when the pyrolysis temperature of the working fluid is 250° C., the predetermined upper limit temperature can be 225° C.

As the open area ratio of the flow regulating plate 14 decreases, the fluid resistance increases. When the open area ratio falls below 15%, the pressure loss sharply increases. A large pressure loss increases the power consumption of a fan for causing the heat source gas to flow. The pressure loss of the evaporator 10 needs to be suppressed to achieve a high-performance Rankine cycle system.

According to the result, the open area ratio of the flow regulating plate 14 can be determined to be greater than or equal to 15% and less than or equal to 35%. The open area ratio in this range enables the pressure loss to be sufficiently suppressed while pyrolysis of the working fluid is prevented.

The heat source gas passing through the heating portion 15 passes through the decreasing portion 16 and reaches the heat source gas discharging portion 17. The decreasing portion 16 has, for example, the same structure as the increasing portion 13.

The heat source gas discharging portion 17 is connected at a heat source gas outlet pipe joint 20 to a heat source gas outlet pipe 18. The cross-sectional shape of the heat source gas outlet pipe 18 is typically circular. Accordingly, the cross-sectional shape of the heat source gas discharging portion 17 can also be circular. The heat source gas discharging portion 17 defines the heat source gas outlet 23. The heat source gas is discharged from the evaporator 10 to the outside through the heat source gas outlet 23, and the heat source gas at a high temperature does not leak from the joint 20. The method of connecting the heat source gas discharging portion 17 and the heat source gas outlet pipe 18 is not particularly limited. In the case where the heat source gas discharging portion 17 and the heat source gas outlet pipe 18 each have a flange structure at an end thereof, the heat source gas discharging portion 17 and the heat source gas outlet pipe 18 can be connected to each other by bolting (flange connection). The heat source gas discharging portion 17 and the heat source gas outlet pipe 18 may be completely joined to each other by another connecting method such as welding.

The technique disclosed in the present disclosure is particularly effective in the case where the working fluid is an organic working fluid. More specifically, the technique is particularly effective in the case where the temperature of the heat source gas exceeds the pyrolysis temperature of the working fluid. The use of an organic working fluid enables construction of not only a Rankine cycle system using a high temperature heat source such as a gas boiler but also a Rankine cycle system using a comparatively low temperature heat source. The Rankine cycle system 100 can be operated with a higher efficiency as the temperature of the heat source gas increases. In an example, the maximum temperature of combustion gas produced by a gas boiler is 1500° C. and the pyrolysis temperature of an organic working fluid is in the range from 150 to 300° C.

The technique disclosed in the present disclosure can be applied to not only a heat recovery system that recovers heat by using a working fluid and uses the recovered heat but also a cogeneration system such as a combined heat and power (CHP) system.

What is claimed is:

1. A Rankine cycle system comprising:

a working fluid passage that forms a loop through which a working fluid flows;

an expander disposed in the working fluid passage;

a condenser disposed in the working fluid passage;

a generator driven by the expander; and an evaporator disposed in the working fluid passage, wherein the evaporator includes:

an introducing portion that introduces a heat source gas from a heat source gas pipe;

a heat source gas passage through which the heat source gas introduced from the introducing portion flows;

a heating portion that is disposed in the heat source gas passage and at which the working fluid is heated by the heat source gas;

an increasing portion that is located between the introducing portion and the heating portion, that constitutes the heat source gas passage, and at which a cross-sectional area of the heat source gas passage gradually increases from an upstream side towards a downstream side in the heat source gas passage; and a flow regulating plate that is disposed on any portion between an end of the increasing portion and an inlet of the heating portion, inclusive, in the heat source gas passage and that has a plurality of holes which allow the heat source gas to pass through the plurality of holes, wherein the heating portion includes a heat transfer pipe constituting a part of the working fluid passage through which the working fluid flows.

2. The Rankine cycle system according to claim 1, wherein an open area ratio of the flow regulating plate is greater than or equal to 15% and less than or equal to 35%.

3. The Rankine cycle system according to claim 1, wherein the heating portion includes a heat transfer pipe constituting a working fluid passage, and wherein a diameter of each of the plurality of holes is smaller than an outer diameter of the heat transfer pipe.

4. The Rankine cycle system according to claim 1, wherein the heating portion includes a working fluid passage through which the working fluid flows, wherein the working fluid passage includes a plurality of tiers including a first tier, a second tier, and a third tier that are arranged in the direction in which the heat source gas flows, the working fluid passage having a meandering shape at each of the plurality of tiers, wherein the first tier is a tier located on a most upstream side in the direction in which the heat source gas flows, wherein the second tier is a tier including a working fluid outlet through which the working fluid is discharged from the heating portion to an outside, and wherein the third tier is a tier that is located on a most downstream side in the direction in which the heat source gas flows and that includes a working fluid inlet through which the working fluid is introduced from the outside into the heating portion.

5. The Rankine cycle system according to claim 4, wherein the working fluid passage includes a superheat zone including the first tier and the second tier and an evaporation zone including the third tier, wherein the second tier is disposed on a most downstream side in the superheat zone in the direction in which the heat source gas flows, and a plurality of tiers including the first tier and the second tier define the superheat zone such that heat is exchanged between the heat source gas and the working fluid in a parallel-flow manner, wherein the third tier is disposed on a most downstream side in the evaporation zone in the direction in which the heat source gas flows, and a plurality of tiers including the third tier define the evaporation zone such that heat is exchanged between the heat source gas and the working fluid in a counter-flow manner, and wherein the working fluid flowing through a tier on a most upstream side in the evaporation zone in the direction in which the heat source gas flows is supplied to the first tier.

6. The Rankine cycle system according to claim 1, wherein the working fluid is an organic working fluid.

* * * * *